US005688197A

United States Patent [19]

Peeters et al.

[11] Patent Number: 5,688,197

[45] Date of Patent: Nov. 18, 1997

[54] METHOD AND APPARATUS FOR TRAINING GOALKEEPERS

[76] Inventors: Peter Hubertbus Peeters, R.R. #4, Edmonton, Alberta, Canada, T5E 5S7; Richard St. Croix, 27 Brigantine Bay, Winnipeg, Manitoba, Canada, R3P 1B5

[21] Appl. No.: 694,662

[22] Filed: Aug. 9, 1996

[51] Int. Cl.[6] ..... A63B 69/00

[52] U.S. Cl. ..... 493/446; 473/563

[58] Field of Search ..... 273/57.2, 67 A; 473/446, 560–563, 132

[56] References Cited

U.S. PATENT DOCUMENTS

| | | | |
|---|---|---|---|
| 3,561,760 | 2/1971 | Klay | 273/67 A |
| 4,023,797 | 5/1977 | Sarrasin | 273/57.2 |
| 4,361,325 | 11/1982 | Jansen | 273/67 A |
| 5,120,055 | 6/1992 | McCarthy et al. | 273/57.2 |
| 5,263,711 | 11/1993 | Addis et al. | 273/67 A |
| 5,548,481 | 8/1996 | Caluori et al. | 273/57.2 |

*Primary Examiner*—Paul E. Shapiro
*Attorney, Agent, or Firm*—Anthony R. Lambert

[57] ABSTRACT

An apparatus for training goalkeepers including, in combination, a reel containing a quantity of line and a goal. A reel support member is provided to which the reel is mounted. A reel support line guide is positioned on the reel support. A line anchor is positioned on the reel support. The goal has a first lower corner and a second lower corner. A first lower corner line guide is positioned in the first lower corner. A second lower corner line guide is positioned in the second lower corner. A remote end of the line is fed from the reel through the reel support line guide, the first lower corner line guide, the second lower corner line guide and back to the reel support line guide; with the remote end of the line being secured to the line anchor. The line provides an outline of a shooting zone. The shooting zone is dynamically changeable during training sessions by feeding or retracting the line from the reel.

11 Claims, 6 Drawing Sheets

METHOD AND APPARATUS FOR TRAINING GOALKEEPERS

FIELD OF THE INVENTION

The present invention relates to a method and associated apparatus for training goalkeepers, and in particular goalkeepers in the game of hockey.

BACKGROUND OF THE INVENTION

Many sports have a goal, which is an area into which participants must direct a projectile in order to score. While some sports, such as basketball, have prohibitions against goal tending, usually the rules permit a player to be assigned to defend the goal. The player assigned to defend the goal is referred to as a "goalkeeper". The line that the projectile must cross in order to score is referred to as the "goal line".

When a player shoots a projectile, in order to have a chance of scoring, the projectile must be aimed within the boundaries of the goal as defined by goal posts. This creates a triangular shooting zone with the projectile positioned at its apex and the goal posts in the opposite corners. The goalkeeper must position himself between the opposing player and the goal in order to stop the shot from scoring.

At higher levels of competition, opposing players have shots that are both hard and accurate. A goalkeeper is unlikely to be successful if remains on the goal line and attempts to rely solely upon his reflexes to react in sufficient time to stop the shot. For this reason, goaltending coaches teach goalkeepers to move out of the goal toward the opposing player who is attempting to shoot in order to occupy as much of the shooting zone as possible. By moving out the goalkeeper cuts down the angles on either side of him within the shooting zone that a projectile can travel and still strike the goal. In a game situation the shooting zone is constantly changing as the opposing player moves or passes to a team mate. The goalkeeper must learn to reposition himself in response to changes in the shooting zone.

In order to teach goalkeepers the concept of a shooting zone, coaches have, in the past, laid markers down to demonstrate the triangular boundaries of the shooting zone. Although this is useful, it does not adequately replicate the rapid changing of the shooting zone that a goalkeeper must adjust to under game conditions.

SUMMARY OF THE INVENTION

What is required is an apparatus for training goalkeepers that more closely replicates game conditions.

According to one aspect of the present invention there is provided an apparatus for training goalkeepers which includes an elongate support. A reel containing a quantity of line is mounted on the support. The reel includes means for feeding or retracting line. A line guide is positioned on the reel support.

According to another aspect of the present invention there is provided a method of training goalkeepers. Firstly, providing an apparatus, as described above. Secondly, providing a goal having a first lower corner and a second lower corner. Thirdly, feeding the remote end of the line from the reel through the line guide, to the first lower corner of the goal, across the goal to the second lower corner of the goal and back to the line guide with the remote end of the line. The line provides an outline of a shooting zone, the shooting zone being dynamically changeable during training sessions by moving the support while feeding or retracting the line from the reel to keep the line taunt.

According to another aspect of the invention there is provided, in combination, a reel containing a quantity of line and a goal. The reel has means for feeding or retracting line. A reel support member is provided to which the reel is mounted. A reel support line guide is positioned on the reel support. A line anchor is positioned on the reel support. The goal has a first lower corner and a second lower corner. A first lower corner line guide is positioned in the first lower corner. A second lower corner line guide is positioned in the second lower corner. A remote end of the line is fed from the reel through the reel support line guide, the first lower corner line guide, the second lower corner line guide and back to the reel support line guide; with the remote end of the line being secured to the line anchor. The line provides an outline of a shooting zone. The shooting zone is dynamically changeable during training sessions by feeding or retracting the line from the reel.

With the training apparatus, as described above, a coach can dynamically change the shooting zone and watch to see whether the goalkeeper adjusts to the changes in the shooting zone. This enables the coach to prepare the goalkeeper for rapid changes in the shooting zone that will take place during the game due to passes or player movement.

Although beneficial effects may be obtained through the use of the training apparatus, as described above, the goal has a height dimension as well as a width dimension. A goalkeeper must be trained to defend against shots directed toward the upper corners of the goal. Even more beneficial results may, therefore, be obtained when the goal has a first upper corner and a second upper corner. A first upper corner line guide is positioned in the first upper corner. A second upper corner line guide is positioned in the second upper corner. The line is fed from the reel through the reel support line guide, the first lower corner line guide, the first upper corner line guide, back to the reel support line guide then to the second lower corner line guide, the second upper corner line guide, back to the reel support line guide where it is secured to the line anchor. The line provides a three dimensional outline of a shooting zone.

Although beneficial results may be obtained through the use of the training apparatus, as described above, sometimes goalkeepers make a mistake by concentrating upon the opposing player instead of the ball or puck that serves as the game projectile. When this occurs, the goalkeeper receives a distorted impression of the shooting zone. Even more beneficial effects may, therefore, be obtained when a game projectile is mounted to the reel support. Preferably, the reel support line guide is secured to the game projectile so that the lines defining the shooting zone appear to originate from the game projectile.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
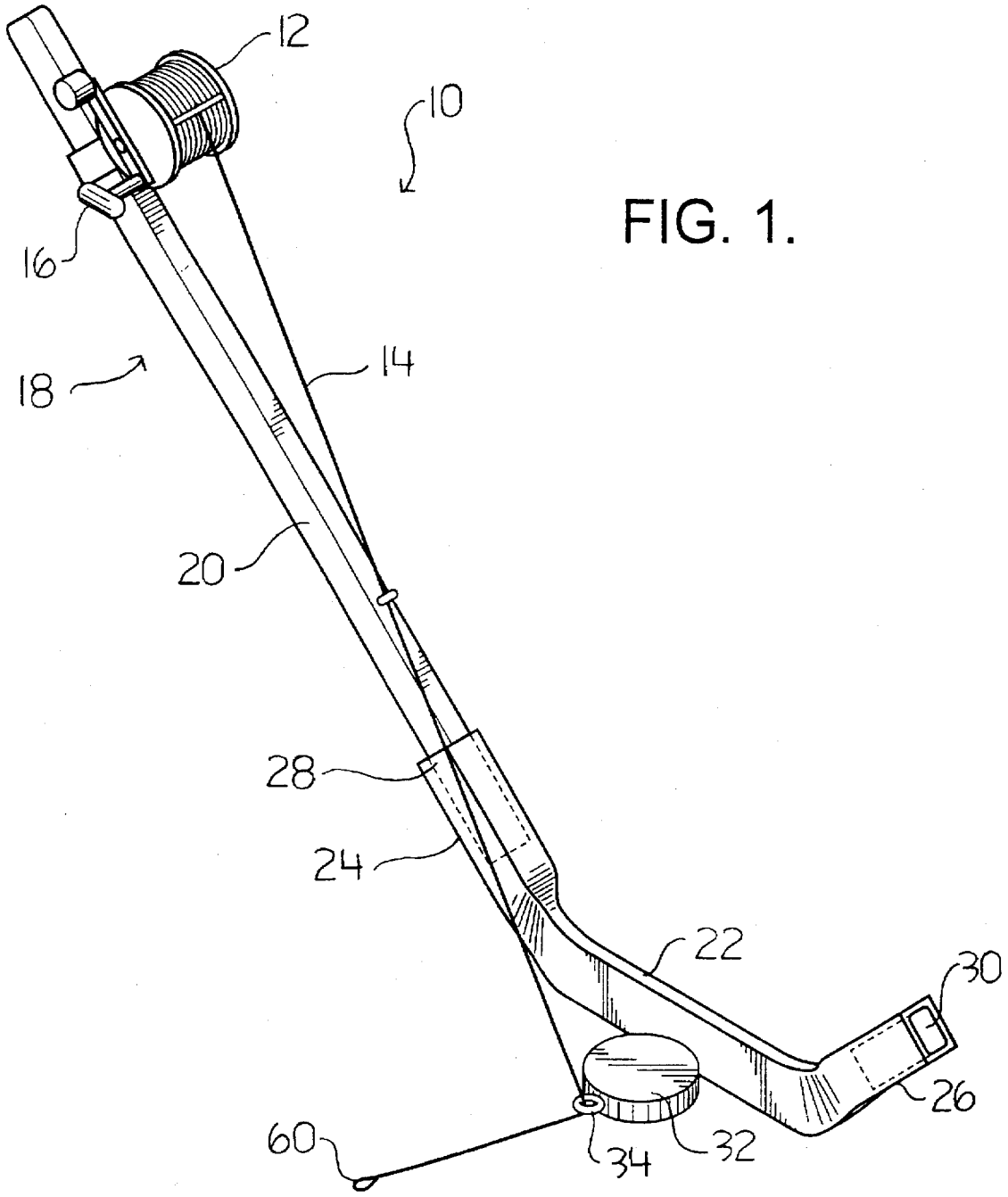
FIG. 1 is a perspective view of a reel mounted on a reel support that serve as a portion of the combination apparatus for training goalkeepers constructed in accordance with the teachings of the present invention.

The preferred embodiment, an apparatus for training goalkeepers generally identified by reference numeral 10, will now be described with reference to FIGS. 1 through 7. In the description that follows the game of hockey has been selected to illustrate the principles of the present invention. It will be appreciated that the principles demonstrated can readily be adapted to other sports.

Figure 3:
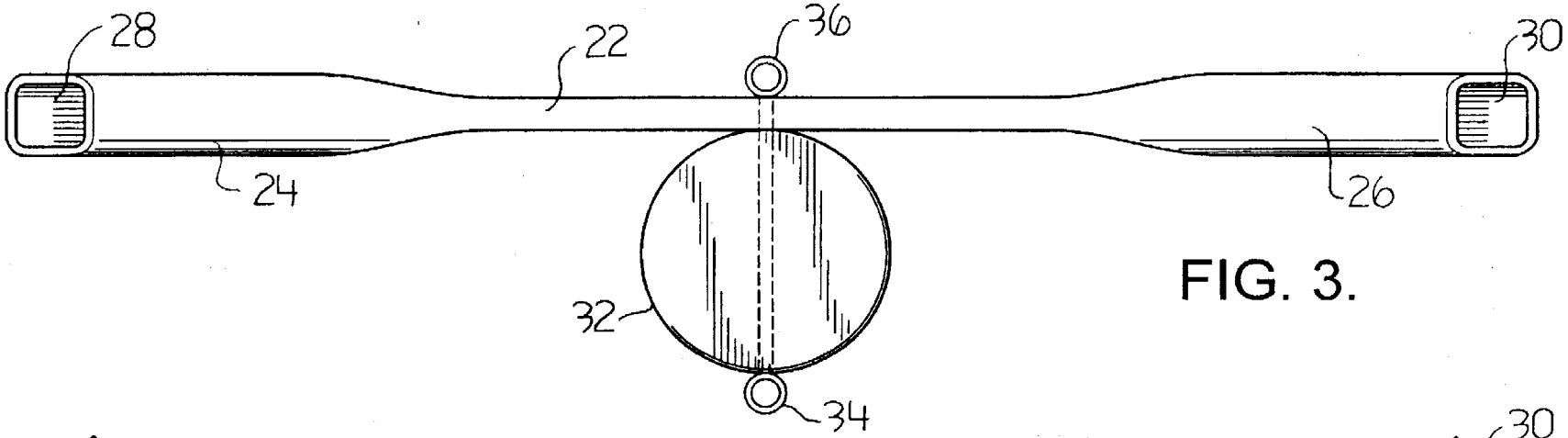
FIG. 3 is a top plan view of a blade portion of the reel support illustrated in FIG. 1.
Figure 4:
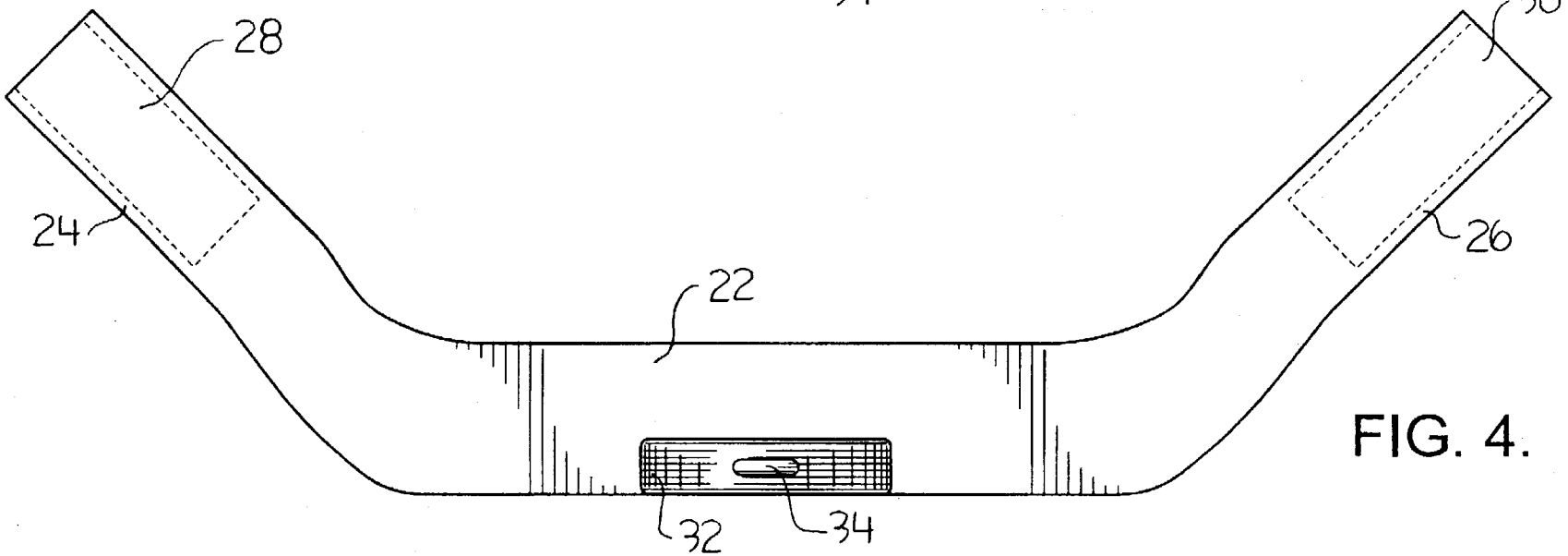
FIG. 4 is a front elevation view of a blade portion of the reel support illustrated in FIG. 1.
Figure 5:
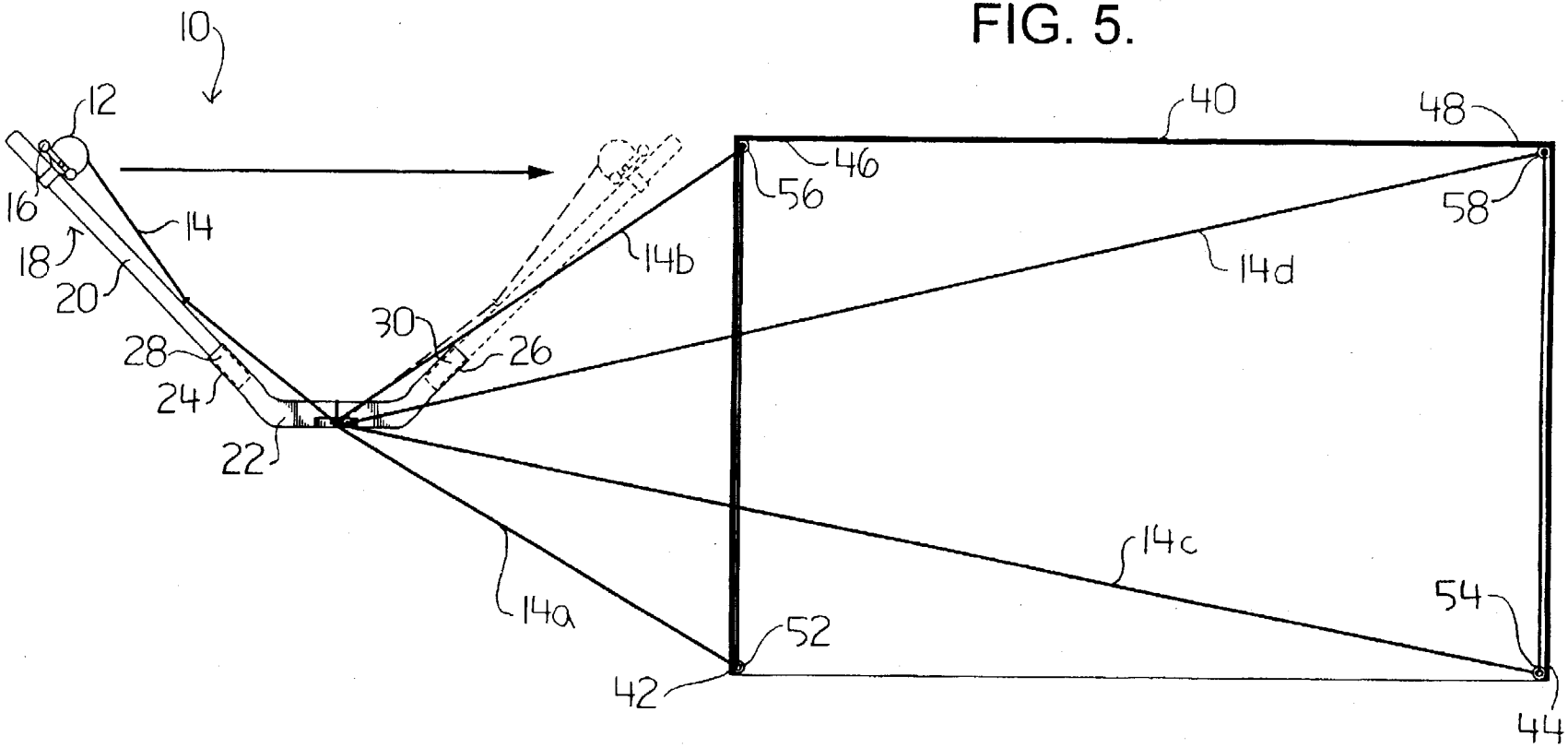
FIG. 5 is a perspective view of the combination apparatus for training goalkeepers illustrated in FIG. 2, showing alternative positioning of a shaft portion of the reel support.

Referring to FIG. 1, goalkeeper training apparatus 10 includes a reel 12 containing a quantity of line 14. A crank 16 serves as means for feeding or retracting line 14 from reel 12. A hockey stick shaped reel support member 18 is provided having a shaft 20 and a blade 22. Reel 12 is mounted to shaft 20. Referring to FIGS. 1, 3 and 4, blade 22 has a first end 24 and a second end 26. Alternative shaft attachment receptacles 28 and 30 are provided at first end 24 and second end 26, respectively, of blade 22. Shaft 20 is detachably secured to blade 22, by inserting shaft 20 into either receptacle 28 or 30. The alternative positioning of shaft 20 is illustrated in FIG. 5, and will hereinafter be further described. Referring to FIGS. 1, 3 and 4, a hockey puck 32 is mounted to blade 22 of hockey stick shaped reel support member 18. A reel support line guide 34 is positioned on hockey puck 32. Referring to FIG. 3, A line anchor 36 is positioned on blade 22 of hockey stick shaped reel support 20 opposite reel support line guide 34. Referring to FIG. 1, one or more supplemental line guides 38 may be provided along shaft 20, depending upon the length of shaft 20. In FIG. 1, one such supplementary line guide 38 has been illustrated.

Figure 2:
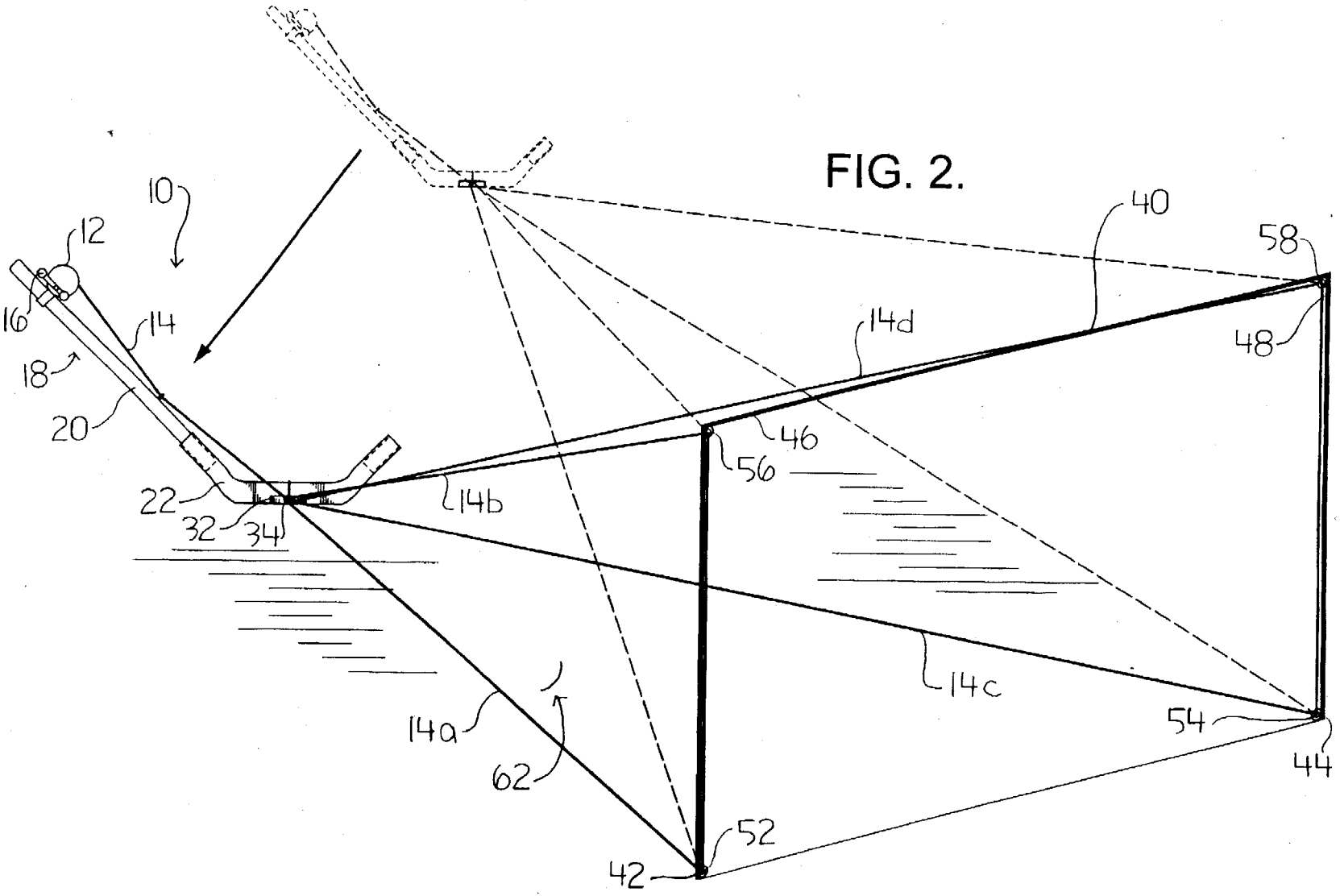
FIG. 2 is a perspective view of the combination apparatus for training goalkeepers constructed in accordance with the teachings of the present invention.

Referring to FIG. 2, a goal 40 is provided having a first lower corner 42, a second lower corner 44, a first upper corner 46 and a second upper corner 48. A first lower corner line guide 52 is positioned in first lower corner 42. A second lower corner line guide 54 is positioned in second lower corner 44. A first upper corner line guide 56 is positioned in first upper corner 46. A second upper corner line guide 58 is positioned in second upper corner 48. Referring to FIG. 1, a remote end 60 of line 14 is illustrated. Referring to FIG. 2, remote end 60 of line 14 is fed from reel 12 through reel support line guide 34, to first lower corner line guide 52 (identified by line 14*a*), to first upper corner line guide 56, back to reel support line guide 34 (identified by line 14*b*), to second lower corner line guide 54 (identified by line 14*c*), to second upper corner line guide 58, and back to reel support line guide 34 (identified by line 14*d*). In accordance with this teaching line 14 provides a three dimensional outline of a shooting zone, generally indicated by reference numeral 62, with all lines 14*a*, 14*b*, 14*c*, 14*d* that define shooting zone 62 appearing to originate from hockey puck 32. Remote end 60 of line 14 is extended across blade 22 and secured to line anchor 36.

Figure 6:
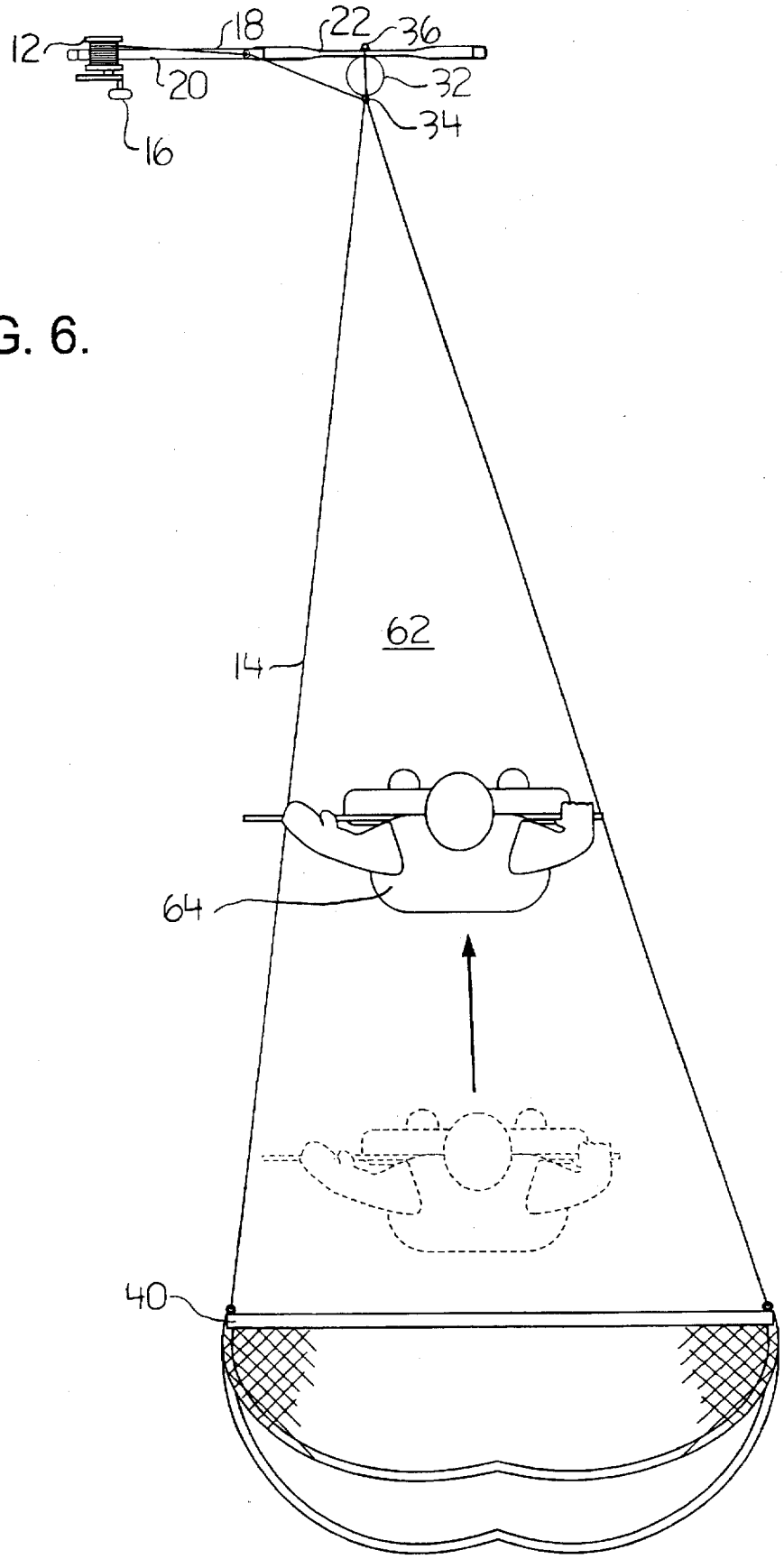
FIG. 6 is a top plan view of the combination apparatus for training goalkeepers illustrated in FIG. 2.
Figure 7:
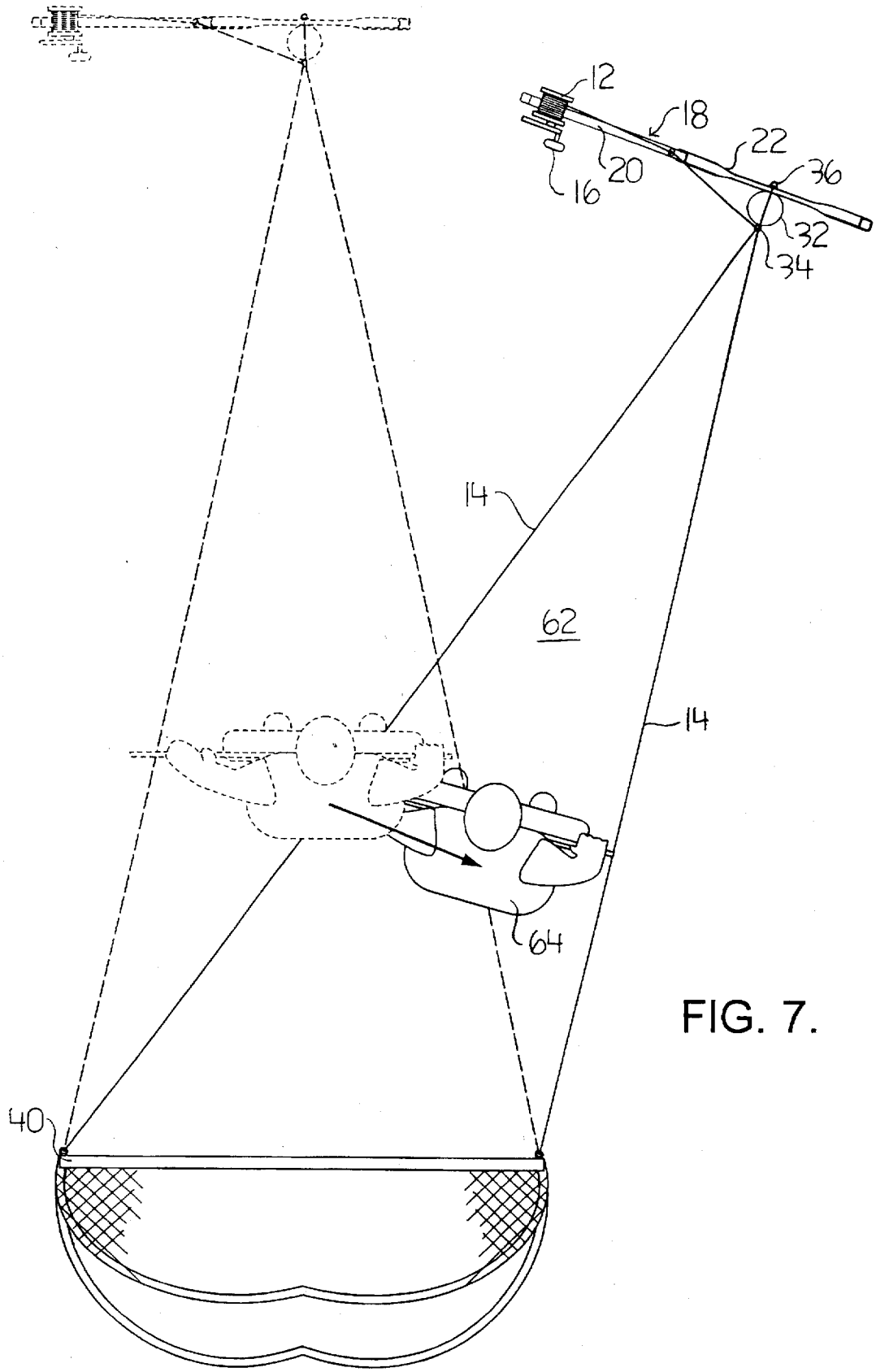
FIG. 7 is an alternative top plan view of the combination apparatus for training goalkeepers illustrated in FIG. 2.

The use and operation of goalkeeper training apparatus 10 will now be described with reference to FIGS. 1 through 7. Referring to FIG. 6, goalkeeper training apparatus 10 demonstrates to goalkeeper 64 the boundaries of shooting zone 62. It is readily apparent that to reduce the area of goal 40 available to an opposing player, goalkeeper 64 must move forward. Defining the boundaries of shooting zone 62 with line 14 helps goalkeeper 64 determine how far he must move forward. Referring to FIG. 7, once goalkeeper 64 has the basic concept he goalkeeper training apparatus 10 can be used to permit adjustment to dynamic changes in shooting zone 62. Shooting zone 62 is dynamically changeable during training sessions by feeding or retracting line 14 from reel 12 by means of crank 16. A coach operating goalkeeper training apparatus 10 can move from side to side, while concurrently feeding or retracting line 14 from reel 12. Referring to FIGS. 2 and 5, the three dimensional nature of shooting zone 62 is illustrated. Goalkeeper 64 must be trained to defend a shooting zone 62 that has a height dimension as well as a width dimension. Referring to FIG. 5, shaft 20 can be placed in either receptacle 28 to simulate a left handed shooter or receptacle 30 to simulate a right handed shooter. This helps demonstrate to goalkeeper 64 that he must concentrate at all times on hockey puck 32. Whether the shooter is left handed or right handed, it can be demonstrated that the shooting zone remains the same.

It will be apparent to one skilled in the art that goaltending training apparatus 10 provides a valuable training tool. With this tool goaltenders can be taught to remain square to the puck, to keep the puck centered on his body, how to play left handed shooters, how to play right handed shooters, and when to move as the shooter moves. The manner of teaching is applicable to any style of goaltender, including butterfly style of professional goaltenders such as Felix Potvin; stand up style of professional goaltenders such as Mike Vernon and flopper style of professional goaltenders such as Dominic Hasek. When four lines are used, apparatus 10 provides the goaltender with the added benefit of a three dimension view.

It will be apparent to one skilled in the art that modifications may be made to the illustrated embodiment without departing from the spirit and scope of the invention as hereinafter defined in the claims.

The Embodiments of the Invention in which an Exclusive Property or Privilege is claimed are defined as follows:

1. An apparatus for training goalkeepers, comprising, in combination:

a reel containing a quantity of line, the reel including means for feeding or retracting line;

a reel support member to which the reel is mounted, a reel support line guide positioned on the reel support, a line anchor positioned on the reel support;

a goal having a first lower corner and a second lower corner, the goal having a first lower corner line guide positioned in the first lower corner and a second lower corner line guide positioned in the second lower corner;

a remote end of the line being fed from the reel through the reel support line guide, the first lower corner line guide and the second lower corner line guide and back to the reel support line guide with the remote end of the line being secured to the line anchor, such that the line provides an outline of a shooting zone, the shooting zone being dynamically changeable during training sessions by feeding or retracting the line from the reel.

2. The Apparatus for training goalkeepers as defined in claim 1, wherein the goal has a first upper corner and a second upper corner, the goal having a first upper corner line guide positioned in the first upper corner and a second upper corner line guide positioned in the second upper corner; the line being fed from the reel through the reel support line guide, to the first lower corner line guide, to the first upper corner line guide, back to the reel support line guide, to the second lower corner line guide, to the second upper corner line guide, and back to the reel support line guide where it is secured to the line anchor, such that the line provide a three dimensional outline of a shooting zone.

3. The apparatus for training goalkeepers as defined in claim 1, wherein the reel support is a shaft.

4. The apparatus for training goalkeepers as defined in claim 1, wherein a game projectile is mounted to the reel support.

5. The apparatus for training goalkeepers as defined in claim 4, wherein the reel support line guide is secured to the game projectile.

6. An apparatus for training hockey goalkeepers, comprising, in combination:

a reel containing a quantity of line, the reel including means for feeding or retracting line;

a hockey stick shaped reel support member having a shaft and a blade, the reel being mounted to the shaft;

a hockey puck mounted to the blade of the hockey stick shaped reel support member, a reel support line guide being positioned on the hockey puck, a line anchor positioned on the hockey stick shaped reel support;

a goal having a first lower corner and a second lower corner, the goal having a first lower corner line guide positioned in the first lower corner and a second lower corner line guide positioned in the second lower corner;

a remote end of the line being fed from the reel through the reel support line guide, the first lower corner line guide, the second lower corner line guide and back to the reel support line guide with the remote end of the line being secured to the line anchor, such that the line provides an outline of a shooting zone, the shooting zone being dynamically changeable during training sessions by feeding or retracting the line from the reel.

7. The Apparatus for training hockey goalkeepers as defined in claim 6, wherein the goal has a first upper corner and a second upper corner, the goal having a first upper corner line guide positioned in the first upper corner and a second upper corner line guide positioned in the second upper corner; the line being fed from the reel through the reel support line guide, to the first lower corner line guide, to the first upper corner line guide, back to the reel support line guide, to the second lower corner line guide, to the second upper corner line guide, and back to the reel support line guide where it is secured to the line anchor, such that the line provide a three dimensional outline of a shooting zone.

8. The apparatus for training hockey goalkeepers as defined in claim 6, the shaft being detachable from the blade of the hockey stick shaped reel support, the blade having a first end and a second end with alternative shaft attachment means at the first end and the second end.

9. An apparatus for training hockey goalkeepers, comprising, in combination:

a reel containing a quantity of line, the reel including means for feeding or retracting line;

a hockey stick shaped reel support member having a shaft and a blade, the reel being mounted to the shaft, the shaft being detachable from the blade of the hockey stick shaped reel support, the blade having a first end and a second end with alternative shaft attachment receptacles at the first end and the second end;

a hockey puck mounted to the blade of the hockey stick shaped reel support member, a reel support line guide being positioned on hockey puck, a line anchor positioned on the hockey stick shaped reel support;

a goal having a first lower corner, a second lower corner, a first upper corner and a second upper corner, the goal having a first lower corner line guide positioned in the first lower corner, a second lower corner line guide positioned in the second lower corner, a first upper corner line guide positioned in the first upper corner and a second upper corner line guide positioned in the second upper corner;

a remote end of the line being fed from the reel through the reel support line guide, to the first lower corner line guide, to thirst upper corner line guide, back to the reel support line guide, to the second lower corner line guide, to the second upper corner line guide, and back to the reel support line guide with the remote end of the line being secured to the line anchor, such that the line provides a three dimensional outline of a shooting zone, the shooting zone being dynamically changeable during training sessions by feeding or retracting the line from the reel.

10. An apparatus for training hockey goalkeepers, comprising:

an elongate support resembling a hockey stick and having a shaft and a blade;

a reel containing a quantity of line mounted on the shaft of the support, the reel including means for feeding or retracting line;

a hockey puck mounted to the blade of the support; and a line guide secured to the hockey puck.

11. The apparatus for training hockey goaltenders, as defined in claim 10, wherein the blade of the support is detachable from the shaft, the blade having a first end and a second end with alternative shaft attachment receptacles at the first end and the second end.

* * * * *